US008571765B2

(12) United States Patent
Lehtinen et al.

(10) Patent No.: US 8,571,765 B2
(45) Date of Patent: Oct. 29, 2013

(54) DEFINITION OF CONTROL DATA FOR AUTOMATIC CONTROL OF MOBILE MINING MACHINE

(75) Inventors: Antti Lehtinen, Tampere (FI); Hannu Mäkelä, Helsinki (FI); Jarkko Ruokojärvi, Tampere (FI); Jouni Sievilä, Vantaa (FI)

(73) Assignee: Sandvik Mining and Construction Oy, Tampere (FI)

( * ) Notice: Subject to any disclaimer, the term of this patent is extended or adjusted under 35 U.S.C. 154(b) by 32 days.

(21) Appl. No.: 13/380,243

(22) PCT Filed: Jun. 23, 2010

(86) PCT No.: PCT/FI2010/050540

§ 371 (c)(1),
(2), (4) Date: Dec. 22, 2011

(87) PCT Pub. No.: WO2010/149857

PCT Pub. Date: Dec. 29, 2010

(65) Prior Publication Data

US 2012/0095640 A1 Apr. 19, 2012

(30) Foreign Application Priority Data

Jun. 24, 2009 (FI) ..... 20095712

(51) Int. Cl.
*G06F 7/70* (2006.01)

(52) U.S. Cl.
USPC ..... 701/50

(58) Field of Classification Search
USPC ..... 701/23, 25, 50, 59, 400
See application file for complete search history.

(56) References Cited

U.S. PATENT DOCUMENTS

| | | | |
|---|---|---|---|
| 4,079,997 | A | 3/1978 | Bienko et al. |
| 5,615,116 | A | 3/1997 | Gudat et al. |
| 5,881,832 | A | 3/1999 | Zitz et al. |
| 5,922,041 | A | 7/1999 | Anderson |

(Continued)

FOREIGN PATENT DOCUMENTS

| | | |
|---|---|---|
| FI | 20095714 | 12/2010 |
| JP | 60-037339 | 2/1985 |

(Continued)

OTHER PUBLICATIONS

International Search Report for PCT/FI2010/050540, dated Oct. 20, 2010.

(Continued)

*Primary Examiner* — Kim T Nguyen
(74) *Attorney, Agent, or Firm* — Morgan, Lewis & Bockius LLP

(57) ABSTRACT

A method for arranging automatic control of a mobile mining machine equipped with a bucket is disclosed. The method generates a general purpose bucket emptying model that defines at least the path of the bucket of the mining machine for emptying it. The bucket emptying model is stored on a memory. The bucket emptying model is fetched from the memory in response to a need to define emptying the bucket for the route. At least data defining the path of the bucket in the fetched bucket emptying model are appended to the path data for use in the automatic control of the mining machine.

17 Claims, 3 Drawing Sheets

(56) References Cited

U.S. PATENT DOCUMENTS

| | | | | |
|---|---|---|---|---|
| 5,999,865 | A | 12/1999 | Bloomquist et al. | |
| 6,058,344 | A | 5/2000 | Rowe et al. | |
| 6,076,030 | A * | 6/2000 | Rowe | 701/50 |
| 6,195,610 | B1 | 2/2001 | Kaneko | |
| 6,203,111 | B1 | 3/2001 | Ollis et al. | |
| 6,363,632 | B1 * | 4/2002 | Stentz et al. | 37/414 |
| 8,234,059 | B2 | 7/2012 | Sugiyama et al. | |
| 8,364,402 | B2 | 1/2013 | Ross et al. | |
| 2001/0021888 | A1 | 9/2001 | Burns et al. | |
| 2004/0128071 | A1 | 7/2004 | Schradi | |
| 2004/0138799 | A1 | 7/2004 | Makela et al. | |
| 2004/0158355 | A1 | 8/2004 | Holmqvist et al. | |
| 2006/0069471 | A1 | 3/2006 | Makela | |
| 2006/0265166 | A1 | 11/2006 | Mäkelä | |
| 2006/0271235 | A1 | 11/2006 | Pulli et al. | |
| 2007/0027612 | A1 | 2/2007 | Barfoot et al. | |
| 2008/0208415 | A1 | 8/2008 | Vik | |
| 2008/0215390 | A1 | 9/2008 | Gipps et al. | |
| 2009/0043439 | A1 | 2/2009 | Barfoot et al. | |
| 2012/0116666 | A1 | 5/2012 | Mäkelä | |
| 2012/0123678 | A1 | 5/2012 | Poppen et al. | |
| 2012/0158280 | A1 | 6/2012 | Ravenscroft | |
| 2012/0179322 | A1 | 7/2012 | Hennessy et al. | |
| 2012/0191290 | A1 | 7/2012 | Bourque et al. | |
| 2013/0006514 | A1 | 1/2013 | Martin et al. | |

FOREIGN PATENT DOCUMENTS

| | | |
|---|---|---|
| JP | 62-214406 | 9/1987 |
| WO | WO 2004/085965 | 10/2004 |
| WO | WO 2004/085966 | 10/2004 |
| WO | WO 2004/086084 | 10/2004 |
| WO | 2007/012198 | 2/2007 |
| WO | WO 2007/012198 | 2/2007 |
| WO | WO 2007/012199 | 2/2007 |
| WO | WO 2008/036805 | 3/2008 |
| WO | WO 2008/078002 | 7/2008 |
| WO | WO 2008/117712 | 10/2008 |
| WO | 2010/149851 | 12/2010 |
| WO | WO 2010/149857 | 12/2010 |

OTHER PUBLICATIONS

Written Opinion of the International Search Report for PCT/FI2010/050540, dated Oct. 20, 2010.

Finnish Office Action in 20095712 , dated Apr. 22, 2010.

* cited by examiner

DEFINITION OF CONTROL DATA FOR AUTOMATIC CONTROL OF MOBILE MINING MACHINE

RELATED APPLICATIONS

The present application is a U.S. National Phase Application of International Application No. PCT/F12010/050540 (filed 23 Jun. 2010) which claims priority to Finnish Application No. 20095712 (filed 24 Jun. 2009).

FIELD OF THE INVENTION

The invention relates to arranging automatic control of mobile mining machines and especially to defining control data for a mining machine equipped with a bucket for the purpose of arranging automatic control of the mining machine.

BACKGROUND OF THE INVENTION

Various mobile mining machines, such as rock drilling equipment, loading equipment and transport equipment, are used in a mine. Mining machines may be manned or unmanned. Unmanned mining machines may be remote-controlled from a control room, for instance, and they may be equipped with measuring instruments suitable for location determination. Unmanned mining devices may be controlled along a required route in the mine, as long as the location of the device can be determined. The location of the device may be determined by using laser scanners, for instance. For example, WO 2007/012198 discloses a method for automatically guiding a mining vehicle. By driving the mining vehicle manually or by using teleoperation, an operator teaches to the mining vehicle a route, along which the mining device may move without intervention from the operator.

In addition to defining route points, it is also possible to teach other control data by driving the mining machine. So as to make a mining machine equipped with a bucket to automatically move excavated material, it is also possible to teach the filling and emptying of the bucket by operating the machine manually. It is important that, especially during the emptying of the bucket, the path of the boom and bucket are defined correctly. However, teaching the emptying movement is prone to errors. The emptying movement is often taught with an empty bucket, whereby the machine acts in a different manner than with a full bucket.

BRIEF DESCRIPTION OF THE INVENTION

An improved solution has now been developed for defining control data for mobile mining machines equipped with a bucket. The solution is characterised by what is stated in the independent claims. Some preferred embodiments of the invention are set forth in the dependent claims.

According to an aspect of the invention, for defining the control data for a mining machine equipped with a bucket, a general-purpose bucket emptying model is generated, which defines at least the path of the bucket for emptying it. Said bucket emptying model is stored on a memory means for use in the definition of control data for the automatic control of a mining machine comprising one or more buckets. Said bucket emptying model is fetched from the memory means in response to a need to define the emptying of the bucket for a route used for the automatic control of the mining machine. At least data defining the path of the bucket in the bucket emptying model retrieved from the memory means are appended to the route data for use in the automatic control of the mining machine.

The present invention provides several advantages which will become apparent from the detailed description. It is now possible to store for new tasks an approved emptying movement as a general-purpose bucket emptying model, that is, as an emptying model that is not bound to a specific route. It is possible to speed up the introduction of new routes, among other things, because it is no longer necessary to teach the emptying of the bucket separately for each route by manually guiding the machine.

BRIEF DESCRIPTION OF FIGURES

Some embodiments of the invention will now be described in greater detail by means of some preferred embodiments and with reference to the attached drawings, in which.

DETAILED DESCRIPTION OF AN EMBODIMENT OF THE INVENTION

Figure 1:
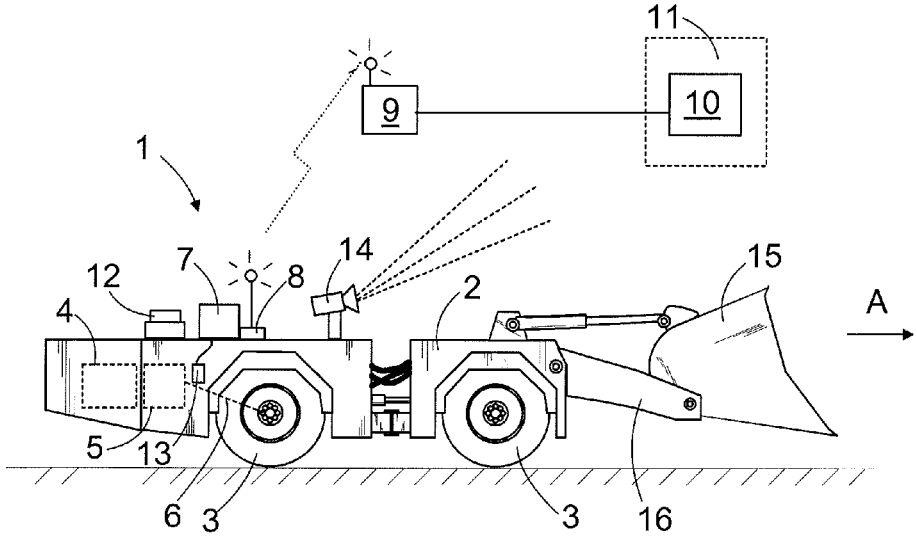
FIG. 1 is a schematic side representation of a mobile mining device.

FIG. 1 shows a mobile mining machine 1, in this case a loading device with a boom 16 and a bucket 15 in front for transporting and loading excavated material. The mining machine 1 comprises a movable carrier 2 with several wheels 3, of which at least one is a drive wheel driven by a motor 4 through transmission. The motor 4 may be an electric motor, combustion engine, hydraulic motor or any other device for providing a rotation torque. Transmission usually comprises a gearbox 5 and required cardan shafts 6, differential gear and other power transmission members for transmitting the rotation torque from the motor 4 to the drive wheels. The mining machine 1 is also equipped with a control system that comprises at least a first control unit 7 that is arranged to control actuators in the mining device 1 for the purpose of controlling and driving the machine.

Further, the mining machine 1 may have a data transfer unit 8, with which the first control unit 7 may establish a data transfer connection to a second control unit 10 external to the mining machine 1 by utilising a wireless connection provided by a base station 9. The second control unit 10 may reside in a control room 11 that may be arranged outside the mine. The control units 7 and 10 may be computers equipped with appropriate software.

It should be noted that a mining machine may generally refer to different machines used in rock excavation operations in a surface or underground production area and which may also be used at other locations than in the actual mines. FIG. 1 is a simplified figure, and the control system of a mining machine 1 typically comprises several units for implementing different control functions. The control system of the mining machine 1 may be a distributed entity formed of modules connected to a CAN (Controller Area Network) bus, for example, which manages all measurements and controls of the machine. The information system of the control room 11 may also comprise one or more servers, databases, operator workstations and a connection to other networks and systems.

The control system of the mining machine 1 comprises a positioning system or unit. According to an embodiment, the positioning system comprises at least one gyroscope 12 that may be used to accurately determine the direction of the machine for positioning. The positioning system further comprises means for determining the distance the machine 1 has traveled. One or more sensors 13 may be used to measure the rotation of the wheel 3. On the basis of the measuring data, the positioning system determines the rotation movement of the wheel and then calculates the distance the machine has traveled. The positioning system may further comprise one or more scanners 14, such as a laser scanner or a corresponding device capable of scanning the space and shapes surrounding the mining machine 1.

Figure 2:
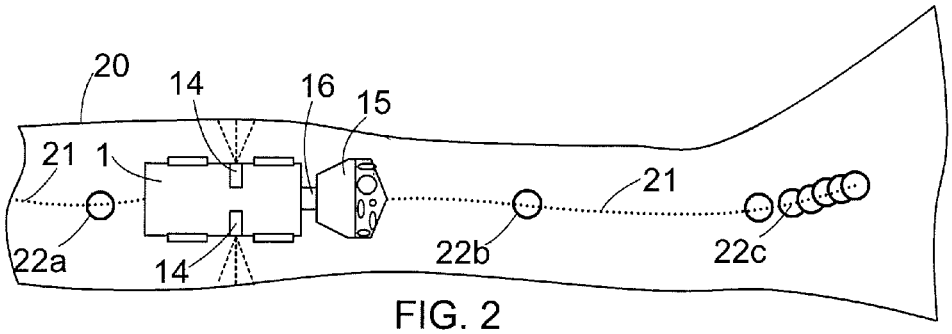
FIG. 2 illustrates from the top an arrangement for positioning and controlling a mining machine according to an embodiment.

FIG. 2 shows in accordance with an embodiment the principle of the definition and use of a route used in positioning and based on scanning. On one or both sides of the mining machine 1, there may be laser scanners 14, with which the profile and surface contours of a mining tunnel 20 may be determined.

The route 21 of the mining machine 1 may be established by teaching. The mining machine 1 is then driven by manual control along the required route and route points 22*a*, 22*b*, 22*c* of the route 21 determined on the basis of location data derived from processing scanning data are stored into a memory. When the required route 21 has been taught and stored into the memory of the control system, the mining machine 1 may be controlled to run the route 21 autonomously. The location of the mobile mining machine 1 may be determined during automatic control by using the laser scanners 14, for instance. The laser scanners scan the wall profiles of the tunnel to determine location on the basis of a pre-stored environment model, and no separate tags, such as reflectors or radio frequency tags, are needed on the tunnel walls. The control system controls the driving of the mining machine on the basis of the determined location and the route point data of the route so that the mining machine remains on the route 21.

As illustrated in FIG. 2, in the bucket emptying area in the surroundings of the route point 22*c*, it is possible to teach several route points at a short distance from each other for the purpose of exactly modelling the bucket emptying movement. Each of these route points may contain the required bucket 15 and boom 16 position data for performing the taught bucket emptying movement. When a mining machine 1 running automatically along this type of route reaches the bucket emptying area, the control unit 7 controls the bucket 15 and boom 16 on the basis of the bucket and boom position data associated with the route points 22*c* of the emptying area for the purpose of performing the emptying movement defined for the route.

Figure 3:
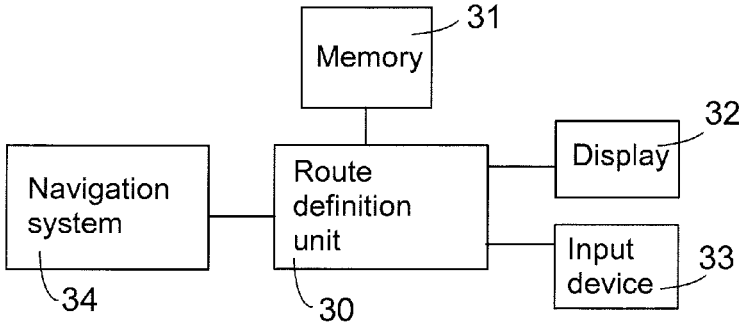
FIG. 3 illustrates an apparatus according to an embodiment for defining routes of a mining machine.

FIG. 3 illustrates an apparatus according to an embodiment. The apparatus comprises at least a unit 30 that is adapted to define general-purpose emptying models and/or use emptying models when defining routes incorporating bucket use. The unit 30, which in the following is referred to as a route definition unit, may implement a route definition application or tool that the user may use via a user interface 32, 33. The route definition unit 30 may implement an algorithm that is arranged to define, according to an embodiment, on the basis of first route data a general-purpose bucket emptying model and/or define for at least one route point of a new route or a second route to be modified position data for the bucket 15 and boom 16 on the basis of a pre-stored emptying model. The term "route" should be understood widely to refer to a driving event of any type or length. A first route, the data of which is used to define the emptying model may for example be a route for transporting excavated material from the excavation site to the emptying site, or just a teaching run of the mining machine performed at the bucket emptying site.

The route definition unit 30 may for instance be implemented by a processor of a general-purpose data processing device, in which one or more computer programs executing route definition functions are run. The computer program comprises a code to implement at least some of the features illustrated in the following and in connection with FIGS. 4 to 5. These features may be part of a route definition application software, but they may also be implemented as a separate application, that is, the route definition application may have a separate application or unit for the generation and/or use emptying models. The computer program may be stored on a machinereadable storage medium, such as a memory 31 or a separate memory means, from which the computer program may be fetched for execution in the processor.

The route definition unit 30 is connected to the memory 31, in which data used in the definition of a route, such as an environment model, property data of the mining machine, and other data and settings affecting route definition, may be stored. The route definition unit comprises an interface for a display 32 and at least one interface for at least one input device 33, such as keyboard and/or mouse. The apparatus may also have one or more other interfaces to other systems. The apparatus typically comprises at least one data transfer unit that may utilise standard TCP/IP-based (Transport Control Protocol/Internet Protocol) network protocols, for instance.

The route definition unit 30 is operationally connectable to a positioning system 34 that determines the location of the mining machine 1 during its run. The positioning system 34 may be part of a navigation system implemented by the mobile mining machine 1, such as the control unit 7, and possibly partly also by the external control unit 10 of the mining machine 1.

The route definition unit 30 may be implemented for instance on a general-purpose workstation arranged as part of the information system of the mine. However, the route definition unit 30 need not be implemented in the data processing equipment used in controlling mining operation or even connectable thereto, which means that defining routes is not fixed to location or specific equipment. However, it should be noted that it is possible to implement at least some of the present technical features related to route definition, for instance the route definition unit 30, in the mobile mining machine 1 and its data processing equipment.

At least the equipment implementing the route definition unit 30 may be implemented in different appropriately configured data processing devices. A software application implementing the route definition unit 30 may be stored in a portable computer, for instance, from which route data may be transferred over a telecommunications connection or using a memory device to the control unit 10 of the control room, for instance.

The system may also have a specific drive task management system, for instance an application executed in the control unit 10 residing in the control room 11. The drive task management system defines drive tasks on the basis of input from the operator and transmits drive task data to the control unit 7 of the mining machine 1. With reference to FIG. 3, the drive task management system may be connected to the memory 31 and it may fetch pre-stored route data from the memory and forward route data and/or control commands to the control unit 7 or navigation system of the mobile mining machine 1.

Figure 4:
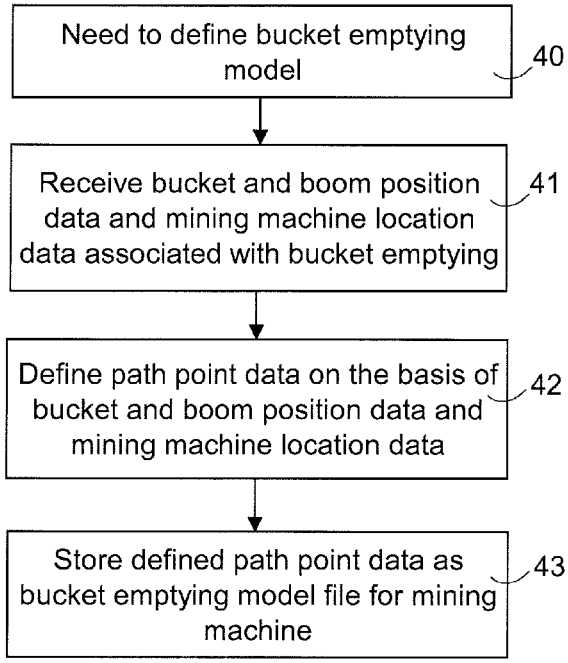
FIG. 4 shows a method according to an embodiment.

FIG. 4 shows a method according to an embodiment, which may be performed in the route definition unit 30 illustrated in FIG. 3, for instance. In step 40, there is a need to define a model illustrating the bucket emptying movement. This may take place in connection with teaching a route, for instance, or later as a separate operation, when a bucket emptying profile taught for a (first) route is found good. Step 40 may be entered into when, for instance, the user of the route definition application selects the definition of a bucket emptying model from the user interface of the route definition application.

In step 41, the application or unit defining the bucket emptying model receives bucket and boom position data and mining machine location data. The data may be obtained by fetching an earlier stored route file selected by the user and retrieving from it at least the data associated with emptying the bucket. The section of the route associated with emptying the bucket may be stored as a separate segment, for instance, so the application may fetch the route point data defined for this segment in step 41.

According to an alternative embodiment, step 41 is entered as part of teaching a new route or immediately after teaching a new route. The data may then even be a direct result of processing data received from the mining machine 1 performing the teaching run.

On the basis of received position data and/or bucket and boom position data, path point data are formed for the bucket and boom in step 42. Path points may be defined or they may already have been defined for an earlier route at predefined intervals or when the position changes to the extent of a predefined threshold value, for instance. According to an embodiment, the path points are defined to directly correspond to the route points of the route data, that is, as many path points are defined to the emptying model as there are on the corresponding section of the route associated with emptying the bucket.

According to an embodiment, in a general-purpose bucket emptying model, distance data from the start or end point of the path are defined for at least some of the path points. This means that the system is not bound to any specific coordinate system. For the location of the mining machine 1, a reference point is then defined from the route points of the route associated with emptying the bucket. The reference point is preferably either the start point or end point of the mining machine 1 path associated with emptying the bucket. For the general-purpose bucket emptying model, it is possible to define for each earlier defined path point of the route distance data from the given reference point by defining the length of the path between said route point and the reference point. In other words, distance information independent of coordinates is calculated to define the distance of the path point from the reference point, which preferably is the start point or end point of the path. The distance information may be defined for each path point of the emptying model.

It should be noted that the path points to be defined need not comprise all above data. It is possible to store into the model, path points that only comprise position data of the bucket and boom or distance data, for instance.

When all path points of the emptying model are defined, the file containing the emptying model may be stored 43 into the memory 31, for instance. The file may be stored in a library set for the route definition application, from which it is easily available to the person using the route definition application when defining routes. The file is given an identifier, for instance a name describing the emptying model. At least position data of the bucket and boom that define the path of the bucket and boom are stored into the file.

According to an embodiment, a structured file format is used, wherein each path point comprising the position value of the bucket, the position value of the boom and the distance data from the reference point forms its own sub-element in the file. At the time of definition, the path point data may also be stored into a temporary file, for instance.

Functions and paths at the bucket emptying site may also be divided into two or more separate emptying models, in which at least some of the steps in FIG. 4 may be performed separately. For instance, it is possible to define and store separate model files for emptying the bucket 15 and exiting the emptying site. It should be noted that it is then not necessary to store other than distance data for the model defining exiting the emptying site for the purpose of controlling the mining machine 1 away from the emptying site.

Figure 5:
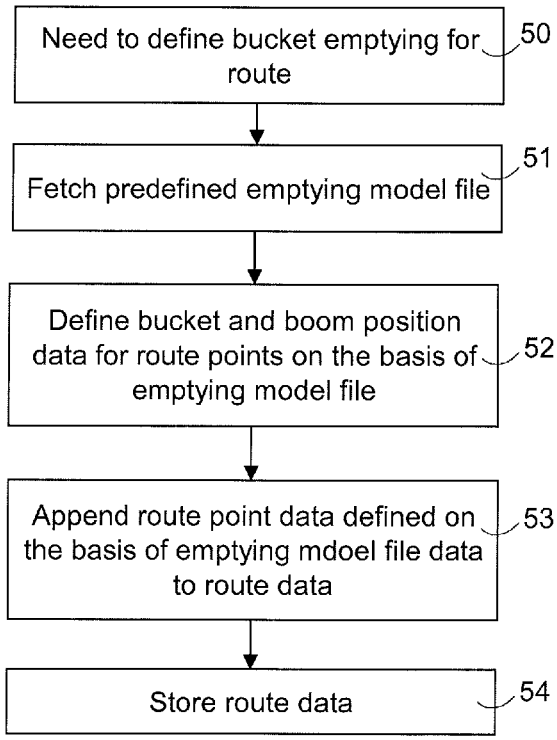
FIG. 5 shows a method according to an embodiment.

FIG. 5 illustrates the utilisation of a predefined and stored bucket emptying model in the definition of routes. The method illustrated in FIG. 5 may be utilised in the route definition unit 30, for instance. In step 50, there is a need to define the emptying of the bucket in a (second) route. This need may occur, for instance, when defining a new route by a teaching run, when altering an already existing route with a new emptying model, or when adding emptying the bucket to an already defined route.

A pre-stored general-purpose emptying model file is retrieved 51 from the memory, for instance from a library defined for the use of the route definition unit 30. The emptying model to be retrieved may be defined on the basis of an input received from the user through the input device 33.

In step 52, at least the bucket and boom position data obtained from the emptying model file retrieved from the memory are added to at least one suitable route point to achieve the emptying sequence and bucket path defined by the emptying model. As illustrated below, step 52 may comprise several sub-steps.

According to an embodiment, the emptying model comprises a set of path points and, for each of the path points, a bucket position value, boom position value and distance from the reference point, for instance from the first or last point of the path being defined, are defined. The definition of the route points is then started for instance from the emptying point of the bucket, and a route point may be defined for each of the path points at different locations.

In step 52, it may be detected for instance on the basis of differing distance information that there is a need to define position data of the bucket and boom for different route points.

According to an embodiment, the most suitable of the already defined route points is selected for each path point, that is, the one that best corresponds to the path point on the basis of the distance information. It is then not necessary to add new route points on the route, but the position data of the bucket and boom in the emptying model may directly be added to the most suitable route points.

According to another embodiment, it is possible to add as necessary a new route point for each path point that differs in location, that is, on the basis of path points at different locations, new navigation points are obtained for the route, if necessary. Alternatively, it is also possible to define directly route points corresponding to the path points of the emptying model file. The coordinates of the new route points may be defined on the basis of the coordinates of at least one route point already defined for the new route and the distance data defined in the bucket emptying model, and these define the distance from the given reference point. Thus, the coordinates of each new route point are then calculated.

Route point data comprising control data associated with emptying the bucket are appended 53 to the route data. Appending should be understood broadly to encompass, for instance, the storing of the bucket path data into the route file, or the storing of a reference or link. Depending on implementation, the data elements of the emptying model file may either be copied as such into to the route data, or only the necessary bucket and boom position values are retrieved from the emptying model file for inclusion in a suitable form into a file defining the route. Thus, functions illustrated in steps 52 and 53 may be implemented in one step. If an earlier route section defining emptying is to be replaced, it is possible to replace the earlier route points of a corresponding route section with the route points defined in step 52.

According to an embodiment, only the distance from the emptying site and the position of the boom and bucket at this distance are stored for each path point in the emptying model. When the emptying model is combined 52, 53 with a taught route, the route definition unit 30 may be arranged to copy only the positions of the boom and bucket, but, at this stage, does not alter other data of the taught route, such as the route point coordinates, gear, or velocity. An algorithm defining the emptying sequence for the route thus searches from the emptying model and taught route a corresponding point by using the distance from the emptying site and only copies the bucket and boom position data. The user only needs to select a suitable emptying model, if several have been stored. The suitability may be defined for instance on the basis of how high the bucket is to be tipped, that is, what is the height of the boom when tipping.

In step 54, the final route data are stored. It should be noted that FIG. 5 is a simplified figure and does not present possible other actions needed for defining the route, such as the definition of route point coordinates and other control data of the mining machine 1.

This enables the utilisation of an approved path of boom and bucket defined for a route when defining other paths. In addition, the emptying movement no longer needs to be taught separately for each route by controlling the machine manually, whereby it is possible to speed up the introduction of new automated routes and to reduce errors. When a pre-stored well-working emptying model is used, a professional driver is no longer needed for the definition of an emptying model. When teaching a new route, it is enough that the driver drives the mining machine 1 to the emptying site in the production area. For example, he does not need to make sure that the boom is lifted in time and high enough.

In addition, later modifying of the emptying model may be reduced or even completely avoided, which speeds up the introduction of new routes.

Several different emptying models, such as tipping with a high boom movement or tipping by shaking the bucket, may be pre-stored into the library available to the route definition application. Thus, an application implementing just the features of FIG. 5 may be sufficient when planning an automated run to the actual production site.

The emptying model is preferably a general-purpose model such that it is not bound to any specific route, in other words, the tipping path may be defined for any route on the basis of the emptying model. However, it should be noted that it is possible to define and store model-specific emptying models for different mining machine models due to their different properties. In connection with the route definition application, it is possible to offer emptying models defined by the manufacturer of the mining machine 1, whereby the introduction of automated control in the production area is further facilitated. Thus, it should be noted that even if the above illustrates generating a bucket emptying model during the making of a route or from the route data, the bucket emptying model may also be generated in other ways and by other means than the route definition application. Bucket emptying models could, for instance, be generated entirely without earlier defined route data by using a design program adapted for this purpose, and even in such a manner that it is not necessary to drive the mining machine to teach the bucket emptying model.

According to an embodiment, the bucket emptying model is stored in a structured XML (extensible markup language) file. An XML file may be processed in the route definition unit 30 in the manner illustrated above. The file defining the route may also be of XML format. However, it should be noted that applying the present embodiments is not limited to a specific storage format, and it is also possible to use other structured storage formats.

An example of an XML-format section of a bucket emptying model is shown below. The example illustrates data of two path points.

```
- <point>
      <bo>40.0</bo>
      <bu>60.0</bu>
      <dist_from_end>0.0</dist_from_end>
  </point>
- <point>
      <bo>40.0</bo>
      <bu>80.0</bu>
      <dist_from_end>1.2</dist_from_end>
  </point>
```

Each sub-element <point> defines the data of a path point defining the path of the bucket and boom. Each sub-element defining a path point comprises a sub-element <bo> for defining the position value of the boom, a sub-element <bu> for defining the position value of the bucket, and sub-element <dist_from_end> for defining the distance from the start point of the path (if it is a path for exiting the emptying site) or end point (if it is an emptying path). The position values of the boom and bucket may be defined as percentages of the extreme value, for instance. However, it should be noted that the data of the bucket emptying model may be defined in a structured form in many different ways and by using elements that possibly differ greatly from the elements illustrated above.

With reference to FIG. 4, in step 42, a required number of path point sub-elements <point> are defined and for them, the values of the elements <bo>, <bu> and <dist_from_end>. With reference to FIG. 5, when new route points are defined in step 52, the route definition unit 30 may be arranged to first define route points starting from the last path point of the emptying path, for example. At this point, the bucket and boom are in suitable positions for transport, and the following points define position values such that the mining machine 1 following the model begins to move the bucket 15 and boom 16 to a more suitable position for emptying. A separate, second path which defines path points on the basis of which the mining machine 1 exits (backwards) from the bucket emptying site, may then be stored into the emptying model.

The above describes some embodiments in which the bucket emptying model defines bucket and boom position data as a percentage of the extreme position, for instance. However, it should be noted that the boom and bucket control data may be defined in the bucket emptying model in many different ways.

According to an embodiment, the bucket emptying model stored for the purpose of defining routes comprises bucket and/or boom control parameters that may be machine-specific. These control parameters may be defined in a form with which it is possible to directly control the bucket 15 and/or boom 16 control members in the mining machine 1. The control parameters are defined on the basis of the teaching run in step 41 of FIG. 4, for instance, and they may be added to the route data in step 53 of FIG. 5. The bucket emptying model could contain for instance a sequence defining the control signals of control valves, such as the control valves of a pressure medium cylinder, affecting the movement of the bucket 15.

According to an embodiment, the routes are defined as interconnected route sections, or segments, that have their own identification codes. For each segment it is, in turn, possible to define (limit) values for driving speeds and other functions according to the properties of the segment. By utilising the general-purpose bucket emptying model described above, it is possible to define quickly bucket emptying sequences for new route segments in such a manner that the mining machine no longer needs to be driven to the segment to empty the bucket for the purpose of teaching the emptying sequence for the segment.

According to an embodiment, the bucket emptying sequence for a computationally generated route or path is defined on the basis of the bucket emptying model. The route may be computationally defined on the basis of a pre-stored environment model, start and end point data received from the user, and the property data of the mining machine. This type of route definition is described in yet more detail in another patent application of the applicant "Determination of driving route for arranging automatic control of mobile mining machine", FI application number 20095714, from which the section concerning route definition without a mining machine run is incorporated herein by reference. The features described above in connection with FIG. 5, for instance, may also be utilised in defining route point data for a route of this type. The bucket and boom position data obtained from the bucket emptying model may be added to one or more route points of the bucket emptying area of the route being defined computationally, when defining the data of the route point. If necessary, it is also possible to add new route points on the basis of the distance data of the emptying model so that the bucket emptying sequence is defined for the route at a sufficient accuracy defined by the emptying model. It is then possible to utilise an approved bucket emptying sequence in defining the route, and emptying the bucket need not be taught by driving the mining machine along the route.

It is obvious to a person skilled in the art that as technology advances, the basic idea of the invention may be implemented in many different ways. The invention and its embodiments are thus not restricted to the examples described above, but may vary within the scope of the claims. Thus, different features may be left out, modified or replaced by equivalent features, and the features described in this patent application may be combined to form various combinations.

The invention claimed is:

1. A method for defining control data for arranging automatic control of a mobile mining machine equipped with a bucket, comprising:

defining for the mining machine control data which define a position of the bucket, generating a general-purpose bucket emptying model that defines at least a bucket path for emptying the bucket of the mining machine, storing said bucket emptying model on a memory means for use in the definition of control data for the automatic control of the mining machine comprising one or more buckets, fetching said bucket emptying model from the memory means in response to a need to define emptying the bucket for a route, and appending at least data defining the path of the bucket in the bucket emptying model fetched from the memory means to data of said route for use in the automatic control of the mining machine.

2. A method as claimed in claim 1, wherein said bucket emptying model comprises path points defining the path of the bucket and boom of the mining machine, and for each path point at least bucket control data and boom control data are defined.

3. A method as claimed in claim 1, comprising:

retrieving from a file defining an earlier defined second route data of route points associated with emptying the bucket, and defining in said bucket emptying model, path points on the basis of the route point data retrieved from the file defining the second route.

4. A method as claimed in claim 3, comprising:

defining for a location of the mining machine a reference point from the route points associated with emptying the bucket in the file defining the earlier defined second route, defining in said bucket emptying model, distance data for the one or more path points from the defined reference point for a purpose of determining the location of the mining machine, and appending data defining at least the bucket path in the bucket emptying model to at least one route point of said route on the basis of the distance data.

5. A method as claimed in claim 1 wherein said bucket emptying model comprises control data for performing a bucket emptying movement and control data for guiding the mining machine away from an emptying site.

6. A method as claimed in claim 1, wherein said bucket emptying model is stored in an XML-format file that comprises path point sub-elements of at least one path, wherein each path point sub-element comprises a sub-element for defining a boom position value, a sub-element for defining a bucket position value, and a sub-element for defining a distance from a start point of the path.

7. An apparatus comprising a data processing device for defining control data used for automatic control of a mobile mining machine, wherein the apparatus is adapted to:

generate a general-purpose bucket emptying model that defines at least a path of a bucket of the mining machine for emptying the bucket, wherein the apparatus is arranged to define in said bucket emptying model path points on the basis of data of route points of an earlier defined route and associated with emptying the bucket; and store said bucket emptying model on a memory means for use in a definition of route data for the automatic control of the mobile mining machine.

8. An apparatus as claimed in claim 7, wherein the apparatus is arranged to define in said bucket emptying model, path points defining the path of the bucket and boom of the mining machine, and defining for each path point at least bucket control data and boom control data.

9. An apparatus as claimed in claim 8, wherein the apparatus is arranged to define for a location of the mining machine, a reference point from the route points associated with emptying the bucket in a file defining the earlier defined route, and the apparatus is arranged to define in said bucket emptying model, distance data for the one or more path points from the defined reference point for a purpose of determining the location of the mining machine.

10. An apparatus as claimed in claim 7, wherein the apparatus is arranged to define in said bucket emptying model, control data for performing a bucket emptying movement and control data for guiding the mining machine away from an emptying site.

11. An apparatus as claimed in claim 7, wherein the apparatus is arranged to store said bucket emptying model in an XML-format file that comprises path point sub-elements of at least one path, wherein each path point sub-element comprises a sub-element for defining a boom position value, a sub-element for defining a bucket position value, and a sub-element for defining a distance from a start point of the path.

12. A non-transitory computer-readable medium comprising:

a computer program for controlling a processing unit, wherein the computer program comprises instructions for execution by the processing unit, and wherein the instructions comprise steps of the method as claimed in claim 1.

13. An apparatus comprising a data processing device for defining control data used for automatic control of a mobile mining machine, wherein the apparatus is arranged to:

fetch a pre-stored general-purpose bucket emptying model from a memory means in response to a need to define an emptying of a bucket for a route, the bucket emptying model defining at least a path of the bucket for emptying the bucket of the mining machine, and append at least data defining the path of the bucket in the bucket emptying model fetched from the memory means to data of said route.

14. An apparatus as claimed in claim 13, wherein said bucket emptying model comprises path points defining the path of the bucket and a boom of the mining machine, and for each path point at least bucket position data and boom position data are defined, and the apparatus is arranged to define on the basis of said bucket emptying model, bucket position data and boom position data for route point data of the route.

15. An apparatus as claimed in claim 13, wherein said bucket emptying model comprises control data for performing a bucket emptying movement and control data for guiding the mining machine away from an emptying site, and the apparatus is arranged to define on the basis of said bucket emptying model, route point data for the route for performing the bucket emptying movement and for guiding the mining machine away from the emptying site.

16. An apparatus as claimed claim 13, wherein the apparatus is arranged to store said bucket emptying model in an XML-format file that comprises path point sub-elements of at least one path, wherein each path point sub-element comprises a sub-element for defining a boom position value, a sub-element for defining a bucket position value, and a sub-element for defining a distance from a start point of the path.

17. An apparatus as claimed in claim 14, wherein said bucket emptying model defines a reference point for a location of the mining machine, distance data for one or more path points of the bucket emptying model from a defined reference point for a purpose of determining the location of the mining machine, and the apparatus is arranged to append data defining at least the bucket path of the bucket emptying model to at least one route point of the route on the basis of the distance data.

* * * * *